US008608507B2

(12) United States Patent
Van Swearingen et al.

(10) Patent No.: US 8,608,507 B2
(45) **Date of Patent: *Dec. 17, 2013**

(54) TOOL-LESS AND VISUAL FEEDBACK CABLE CONNECTOR INTERFACE

(71) Applicant: Andrew LLC, Hickory, NC (US)

(72) Inventors: Kendrick Van Swearingen, Woodridge, IL (US); Julian Rockwell Colapietro, Center Valley, PA (US)

(73) Assignee: Andrew LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/673,027

(22) Filed: Nov. 9, 2012

(65) Prior Publication Data

US 2013/0102178 A1 Apr. 25, 2013

Related U.S. Application Data

(63) Continuation-in-part of application No. 13/571,073, filed on Aug. 9, 2012, and a continuation-in-part of application No. 13/294,586, filed on Nov. 11, 2011, and a continuation-in-part of application No. 13/277,611, filed on Oct. 20, 2011.

(51) Int. Cl.
*H01R 9/05* (2006.01)

(52) U.S. Cl.
USPC ..... 439/578; 439/317

(58) Field of Classification Search
USPC ..... 439/578, 315, 316, 317, 318, 313, 312, 439/311
See application file for complete search history.

(56) References Cited

U.S. PATENT DOCUMENTS

| | | | |
|---|---|---|---|
| 3,701,965 | A | 10/1972 | DuRocher et al. |
| 4,235,498 | A | 11/1980 | Snyder |
| 4,340,269 | A | 7/1982 | McGeary |
| 4,440,464 | A | 4/1984 | Spinner |
| 4,464,001 | A | 8/1984 | Collins |
| 4,502,748 | A | 3/1985 | Brush, Sr. et al. |
| 4,519,661 | A | 5/1985 | Brush, Sr. et al. |
| 4,691,980 | A | 9/1987 | Sandor |
| 4,726,782 | A | 2/1988 | Hager et al. |
| 4,737,119 | A | 4/1988 | Stieler |
| 4,797,111 | A | 1/1989 | Ackmann |
| 5,383,272 | A | 1/1995 | Mattingly et al. |
| 5,431,580 | A | 7/1995 | Tabata |

(Continued)

OTHER PUBLICATIONS

Byung Keon Ahn, International Search Report of Counterpart International Application No. PCT/US12/64570, Apr. 1, 2013, Daejeon Metropolitan City, Korea.

*Primary Examiner* — Hae Moon Hyeon
(74) *Attorney, Agent, or Firm* — Babcock IP, PLLC

(57) ABSTRACT

An electrical connector interface has a male portion and a female portion. The male portion provided with at least three outer diameter radial projecting connector tabs and a conical outer diameter seat surface at an interface end. A releasable retainer seats upon the male portion. The female portion provided with at least three outer diameter radial projecting base tabs and an annular groove open to the interface end with an outer sidewall dimensioned to mate with the conical outer diameter seat surface. the releasable retainer dimensioned to engage the base tabs, upon rotation of the releasable retainer, retaining the outer diameter seat surface against the outer sidewall. A handle projection of the releasable retainer and/or visual engagement indicia may be applied for ease of tool-less interconnection and/or verification of engagement.

18 Claims, 17 Drawing Sheets

(56) References Cited

U.S. PATENT DOCUMENTS

| | | | | |
|---|---|---|---|---|
| 5,662,488 | A | 9/1997 | Alden | |
| 5,722,847 | A | 3/1998 | Haag | |
| 6,039,594 | A | 3/2000 | Zuppa | |
| 6,183,293 | B1 | 2/2001 | Kieninger | |
| 6,226,068 | B1 | 5/2001 | Arcykiewicz et al. | |
| 6,336,822 | B1 * | 1/2002 | Luzzoli | 439/315 |
| 6,338,644 | B1 | 1/2002 | Fritzinger et al. | |
| 6,428,354 | B1 | 8/2002 | Meyer et al. | |
| 6,666,701 | B1 | 12/2003 | Burkhardt et al. | |
| 6,685,493 | B2 | 2/2004 | Birkenmaier et al. | |
| 6,808,407 | B1 | 10/2004 | Cannon | |
| 6,811,423 | B2 | 11/2004 | Yoshigi et al. | |
| 6,884,099 | B1 * | 4/2005 | Cannon | 439/318 |
| 6,921,283 | B2 | 7/2005 | Zahlit et al. | |
| 6,942,526 | B2 | 9/2005 | Wirth | |
| 7,077,677 | B2 | 7/2006 | Sanuki | |
| D576,344 | S | 9/2008 | Conroy | |
| 7,479,033 | B1 | 1/2009 | Sykes et al. | |
| 7,553,177 | B2 | 6/2009 | Antonini et al. | |
| 7,625,226 | B1 | 12/2009 | Gastineau | |
| 7,661,984 | B2 | 2/2010 | McMullen et al. | |
| 7,837,491 | B2 * | 11/2010 | Collin | 439/317 |
| 7,980,781 | B2 | 7/2011 | Trice | |
| 8,177,575 | B2 * | 5/2012 | Katagiyama et al. | 439/345 |
| 2005/0064752 | A1 | 3/2005 | Serino | |
| 2011/0230087 | A1 | 9/2011 | Stantchev | |
| 2012/0129375 | A1 * | 5/2012 | Van Swearingen | 439/314 |
| 2012/0302088 | A1 * | 11/2012 | Van Swearingen et al. | 439/378 |
| 2013/0065420 | A1 * | 3/2013 | Van Swearingen et al. | 439/372 |
| 2013/0065422 | A1 * | 3/2013 | Van Swearingen et al. | 439/378 |

* cited by examiner 2
15
6
4
58
8
56
18
53
16
15

2
15
6
58
4
8
18
53
16
4
8
18
16
15
4

TOOL-LESS AND VISUAL FEEDBACK CABLE CONNECTOR INTERFACE

BACKGROUND

1. Field of the Invention

This invention relates to electrical cable connectors. More particularly, the invention relates to connectors with an interconnection interface for cable connectors utilizing interlocking tab engagement with a reduced interconnection rotation requirement to achieve a rigid interconnection.

2. Description of Related Art

Coaxial cables are commonly utilized in RF communications systems. Coaxial cable connectors may be applied to terminate coaxial cables, for example, in communication systems requiring a high level of precision and reliability.

Connector interfaces provide a connect and disconnect functionality between a cable terminated with a connector bearing the desired connector interface and a corresponding connector with a mating connector interface mounted on an apparatus or a further cable. Prior coaxial connector interfaces typically utilize a retainer provided as a threaded coupling nut which draws the connector interface pair into secure electro-mechanical engagement as the coupling nut, rotatably retained upon one connector, is threaded upon the other connector.

Where connectors are mounted in high density/close proximity to one another and/or nearby obstructions, the connector may be visually obscured and/or rotating the coupling nut during threading to advance the mating portions of the connection interface may be frustrated by the adjacent objects and/or associated cables, requiring frequent resetting of the rotation tool, which increases the time and effort required to make an interconnection.

Passive Intermodulation Distortion (PIM) is a form of electrical interference/signal transmission degradation that may occur with less than symmetrical interconnections and/or as electro-mechanical interconnections shift or degrade over time, for example due to mechanical stress, vibration, thermal cycling, and/or material degradation. PIM is an important interconnection quality characteristic as PIM generated by a single low quality interconnection may degrade the electrical performance of an entire RF system.

Quick connection interfaces are known which require a short rotation to engage pins into slots or the like. For example, a BNC-type connection interface for coaxial cable utilizes a spring contact to provide one hand quick connect and disconnect functionality. The BNC-type connection interface standard includes dimensional specifications that are intended for small diameter cables. As such, a BNC-type connection interface is not designed to support larger diameter and/or heavier coaxial cables and/or may create an unacceptable impedance discontinuity when utilized with a larger diameter coaxial cable. Because of the presence of the spring contact in the BNC-type connection interface, the resulting interconnection is not rigid. Therefore, the BNC-type connection interface may introduce Passive Intermodulation Distortion (PIM) to the resulting interconnection.

Recent developments in RF coaxial connector design have focused upon reducing PIM by improving interconnections between the conductors of coaxial cables and the connector body and/or inner contact, for example by applying a molecular bond instead of an electro-mechanical interconnection, as disclosed in commonly owned US Patent Application Publication 2012/0129391, titled "Connector and Coaxial Cable with Molecular Bond Interconnection", by Kendrick Van Swearingen and James P. Fleming, published on 24 May 2012 and hereby incorporated by reference in its entirety.

Competition in the cable connector market has focused attention on improving interconnection performance and long term reliability of the interconnection. Further, reduction of overall costs, including materials, training and installation costs, is a significant factor for commercial success.

Therefore, it is an object of the invention to provide a coaxial connector and method of interconnection that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figures 1, 2:
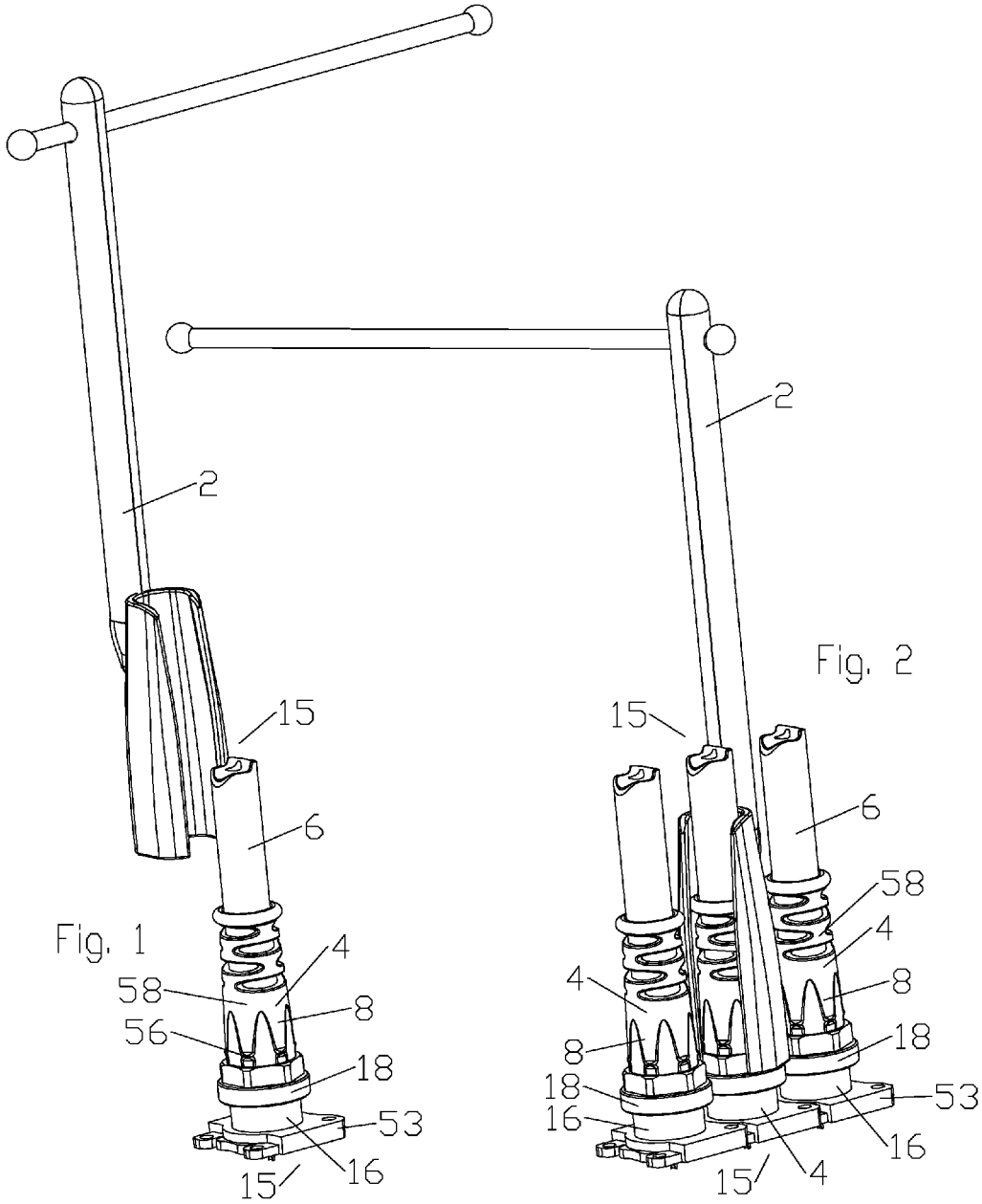
FIG. 1 is a schematic angled isometric view of an exemplary embodiment of a connector with a tabbed interconnection interface, showing a male portion coupled to a female portion, with a basin wrench.
FIG. 2 is a schematic angled isometric view of the interconnection of FIG. 1, demonstrated with the connector in close proximity to adjacent connectors, with the basin wrench attached for rotation of the lock.

The inventor has recognized that threaded interconnection interfaces may be difficult to connect in high density/close proximity connector situations as a basin-type wrench 2 is required to access the connector 4, the wrench handle spaced away from the connector 4 along the longitudinal axis of the connector 4, for example as shown in FIGS. 1 and 2. Although it is possible to thread the connector bodies/coupling nuts together, starting the threading may be difficult as the access to control how the connector bodies are aligning/seating together is frustrated and the repeated rotation required during the threading typically interferes with the cable 6 extending from the connector 4 and/or the cables 6 of adjacent connectors 4. Even where smaller diameter cables 6 are utilized, standard quick connection interfaces such as BNC-type interconnections may provide unsatisfactory electrical performance with respect to PIM, as the connector body may pivot laterally along the opposed dual retaining pins and internal spring element, due to the spring contact applied between the male and female portions, according to the BNC interface specification.

An exemplary embodiment of a tabbed connector interface, as shown in FIGS. 1-17, demonstrates a rigid connector interface where the male and female portions 8, 16 seat together interlocked by sets of symmetrically meshed and interlocking tabs, demonstrated in the present embodiment as sets of three tabs each.

Figure 3:
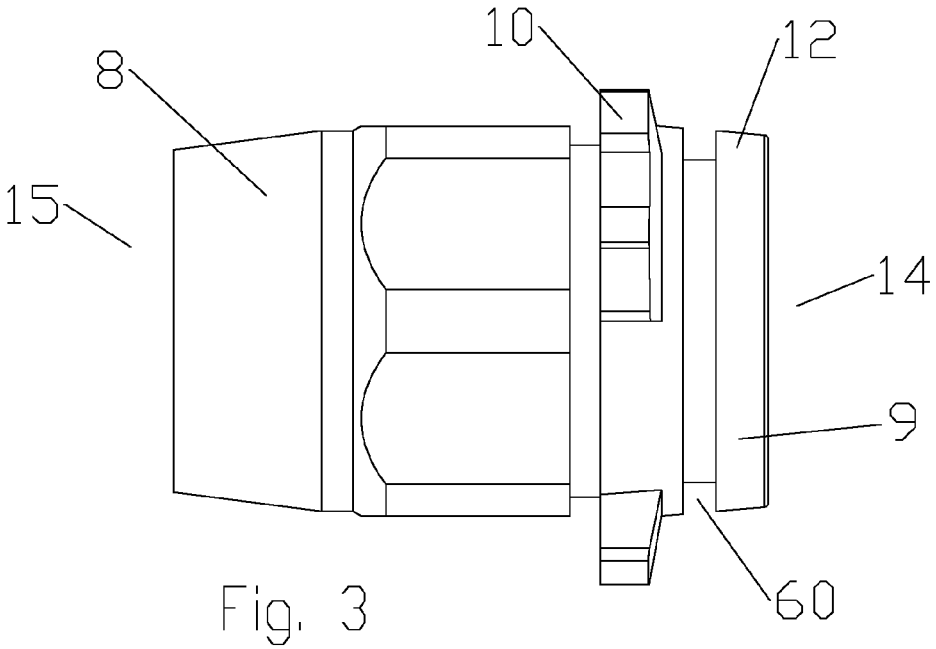
FIG. 3 is a schematic side view of an exemplary male portion of the interconnection of FIG. 1.
Figure 4:
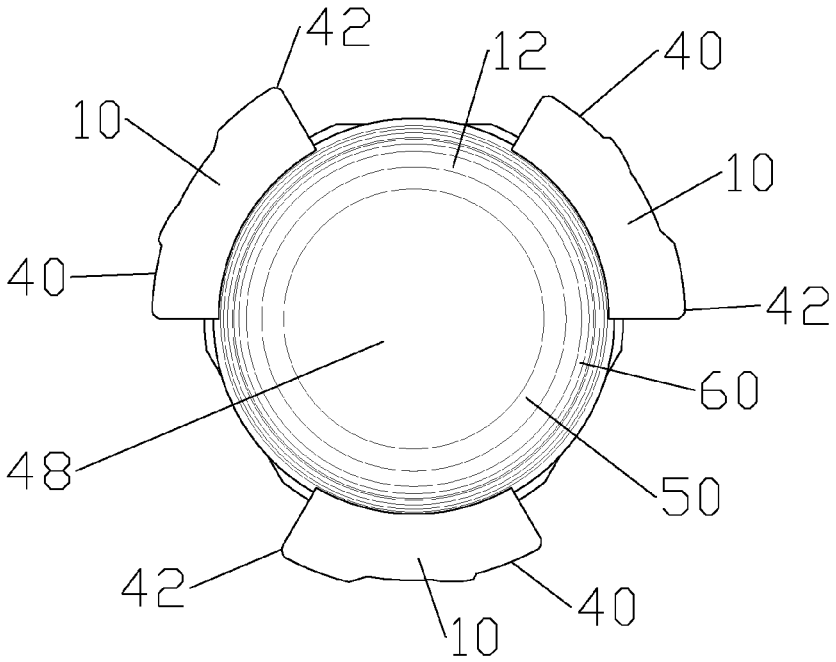
FIG. 4 is a schematic interface end view of the male portion of FIG. 3.

As best shown in FIGS. 3 and 4, a male portion 8 has, for example, three outer diameter radial projecting connector tabs 10 and a conical outer diameter seat surface 12 at an interface end 14.

One skilled in the art will appreciate that interface end 14 and cable end 15 are applied herein as identifiers for respective ends of both the connector and also of discrete elements of the connector described herein, to identify same and their respective interconnecting surfaces according to their alignment along a longitudinal axis of the connector between an interface end 14 and a cable end 15 of each of the male and female portions 8, 16. When interconnected by the connector interface, the interface end 14 of the male portion 8 is coupled to the interface end 14 of the female portion 16.

Figure 5:
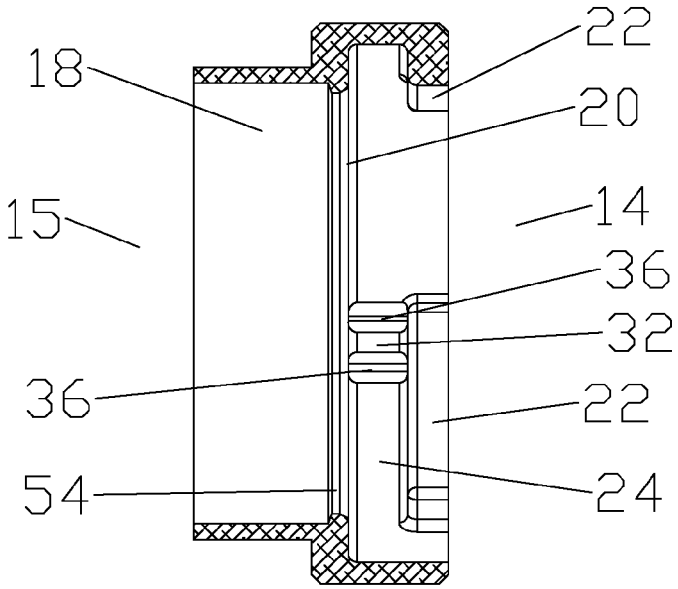
FIG. 5 is a schematic cut-away side view of the releasable retainer of FIG. 6.
Figure 6:
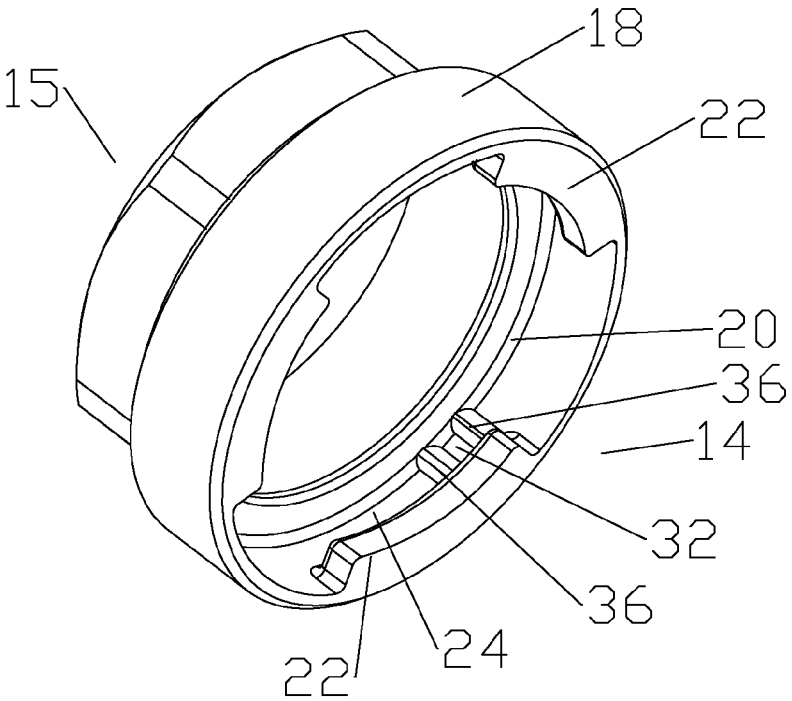
FIG. 6 is a schematic isometric view of an exemplary releasable retainer of the interconnection of FIG. 1.
Figure 7:
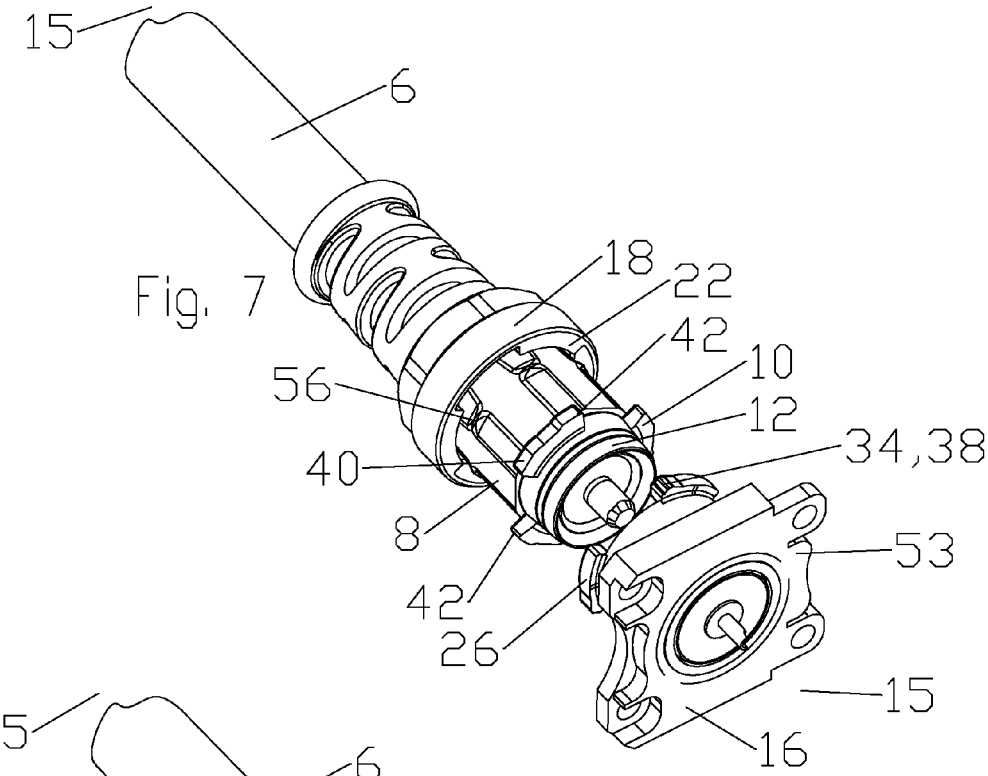
FIG. 7 is a schematic isometric view of the interconnection of FIG. 1, prior to male portion to female portion interconnection, with the releasable retainer advanced towards the cable end.
Figure 8:
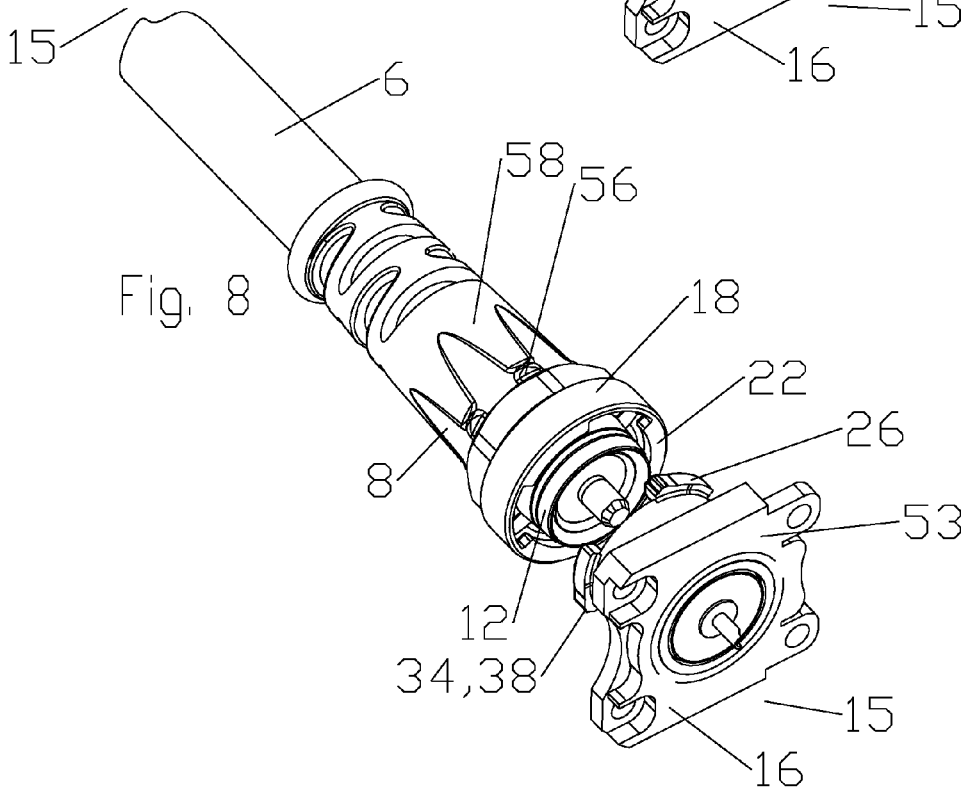
FIG. 8 is a schematic isometric view of FIG. 7, with the releasable retainer seated against the connector tabs and rotated so the coupling tabs are aligned with the connector tabs for initial insertion of the male portion into the female portion.
Figure 9:
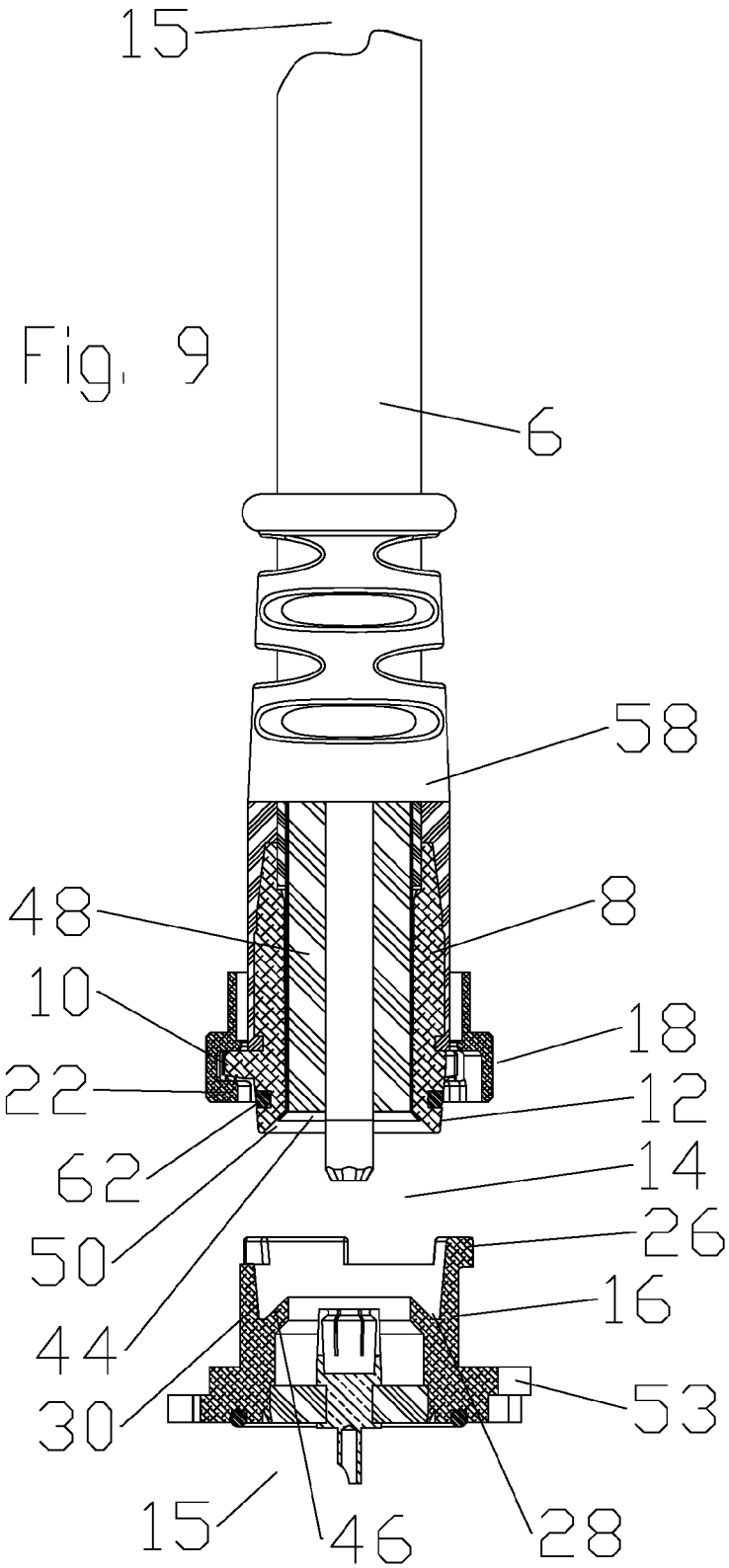
FIG. 9 is a schematic partial cut-away side view of FIG. 8.

As shown in FIGS. 5 and 6, a releasable retainer 18 is provided with a stop shoulder 20 and radially inward coupling tabs 22 proximate the interface end 14. The number of coupling tabs 22 corresponds to the number of connector tabs 10 applied to the male portion 8. The releasable retainer 18 is dimensioned to seat around the male portion 8, the stop shoulder 20 abutting the cable end 15 of the connector tabs 10. A tab seat 24 is provided between the coupling tabs 22 and the stop shoulder 20. As shown in FIG. 7, the releasable retainer 18 may be seated by aligning the coupling tabs 22 with spaces between each of the connector tabs 10 so that the coupling tabs 22 extend below the connector tabs 10 when the stop shoulder 20 is seated against the cable end 15 of the connector tabs 10. As shown in FIGS. 8 and 9, the releasable retainer 18 may then be rotated so that the coupling tabs 22 are in a shadow of the connector tabs 10, ready for insertion of the male portion 8 into the female portion 16.

Figure 10:
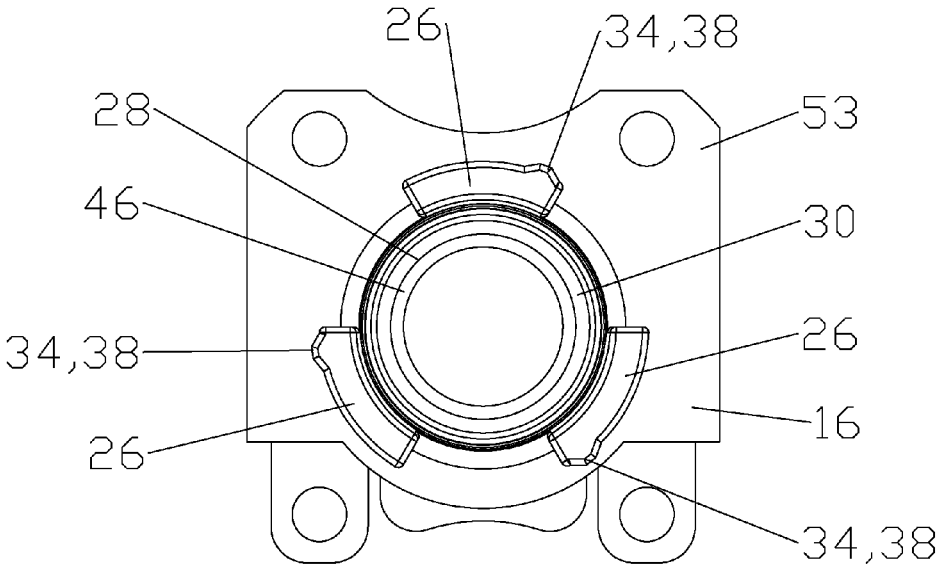
FIG. 10 is a schematic interface end view of the female portion of the interconnection.
Figure 11:
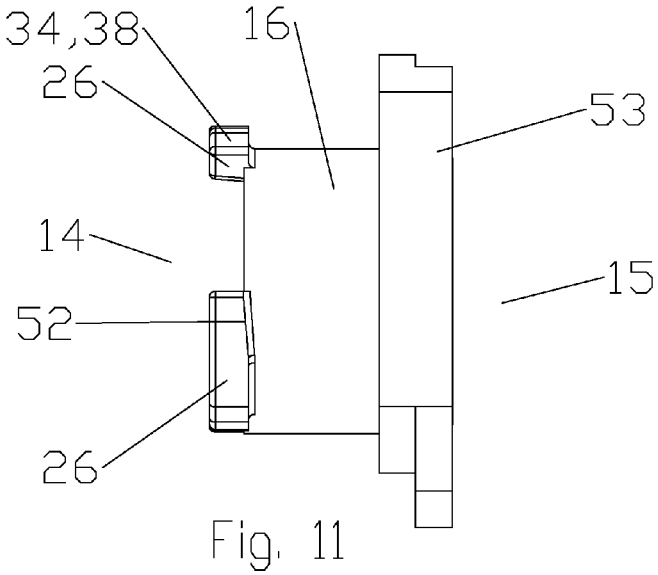
FIG. 11 is a schematic side view of the female portion of FIG. 10.

As shown in FIGS. 10 and 11, the female portion 16 is provided with a plurality of radially projecting base tabs 26, corresponding to the number of connector tabs 10, and an annular groove 28 open to the interface end 14.

Figure 12:
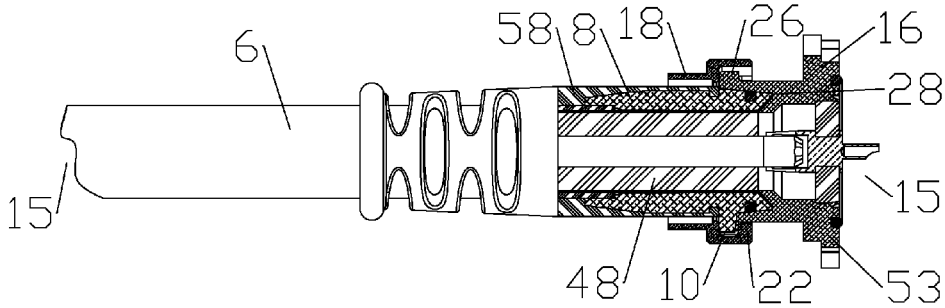
FIG. 12 is a schematic partial cut-away side view of the interconnection of FIG. 1, the male portion seated within the female portion, prior to rotation of the releasable retainer.
Figure 13:
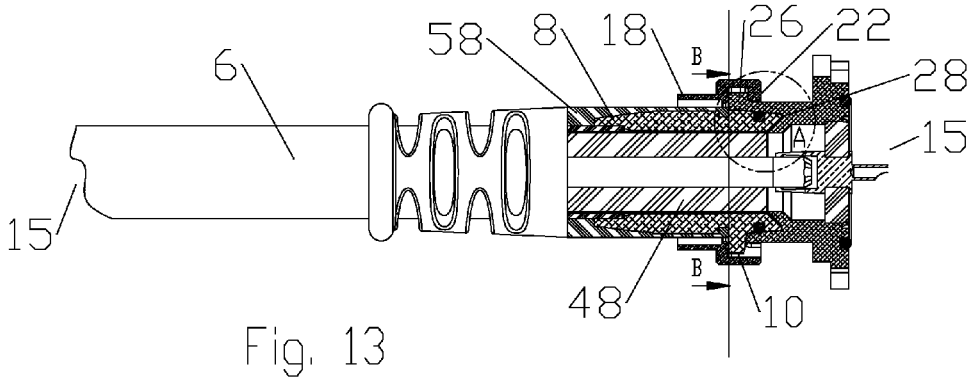
FIG. 13 is a schematic partial cut-away side view of FIG. 12, with the releasable retainer rotated sixty degrees to complete the interconnection.
Figure 14:
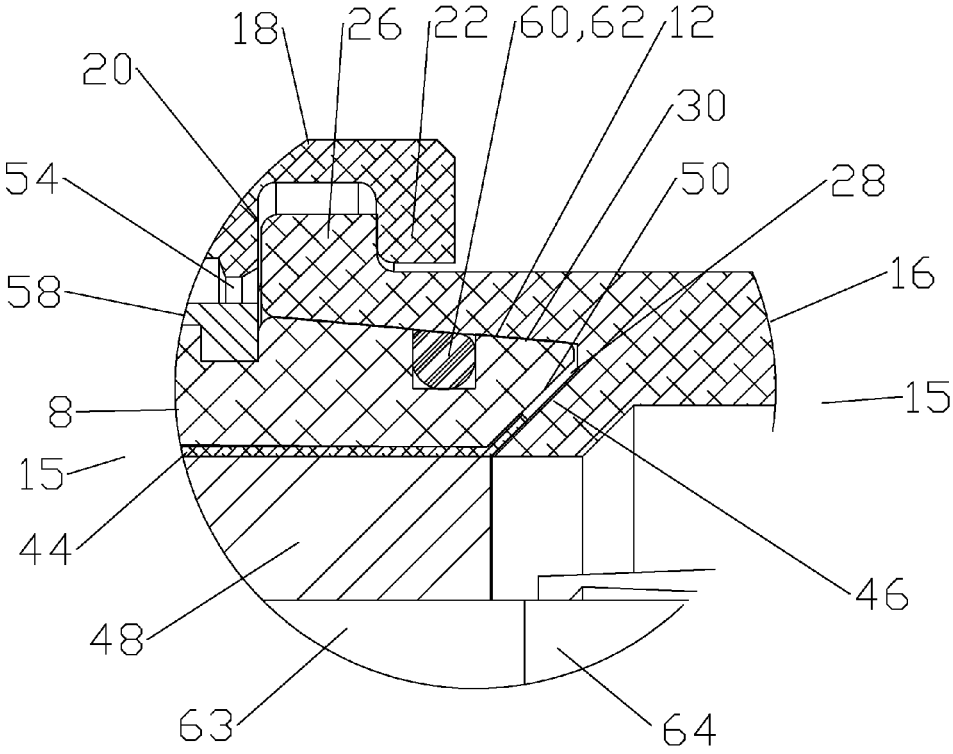
FIG. 14 is a close-up view of area A of FIG. 13.

FIGS. 12-14 demonstrate engagement details as the male portion 8 is seated within the female portion 16 and the releasable retainer 18 rotated to secure the interconnection. As best shown in FIG. 14, an outer sidewall 30 of the annular groove 28 is dimensioned to mate with the male outer conductor coupling surface 9, here provided as a conical outer diameter seat surface 12 enabling self-aligning conical surface to conical surface mutual seating between the male and female portions 8, 16. The base tabs 26 are dimensioned to engage the coupling tabs 22 when the base tabs 26 are inserted into the tab seat 24 as the releasable retainer 18 is rotated, retaining the outer diameter seat surface 12 against the outer sidewall 30 to form a rigid interconnection of the male and female portions 8, 16.

Figure 15:
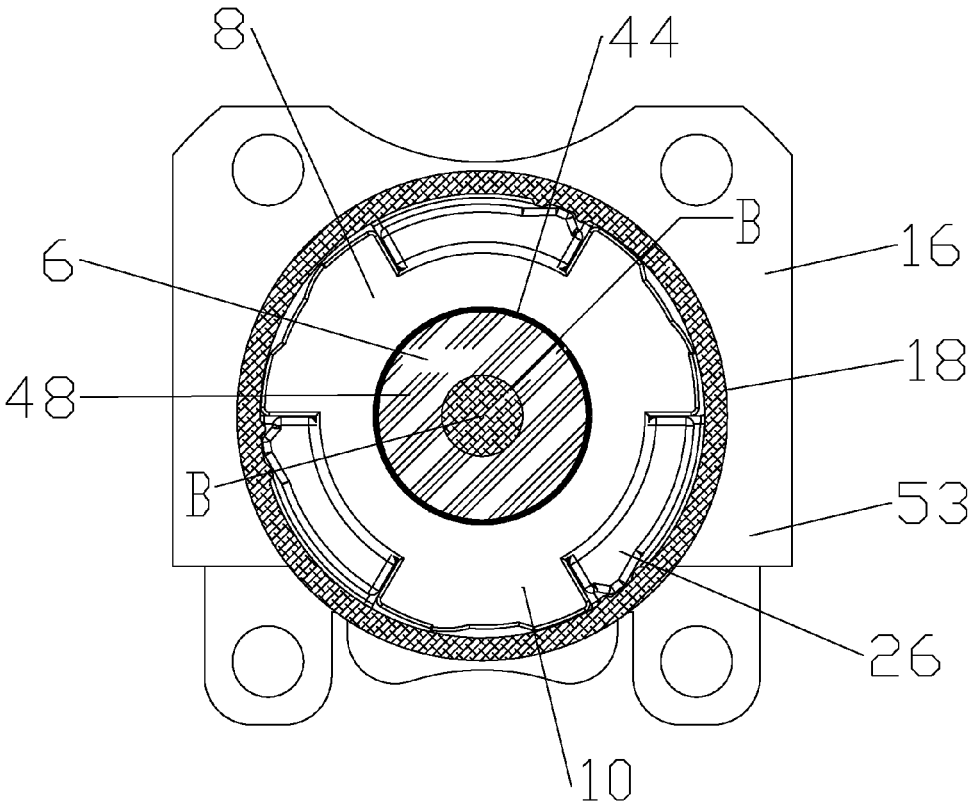
FIG. 15 is a cross-section end view of FIG. 13, along line B-B.
Figure 16:
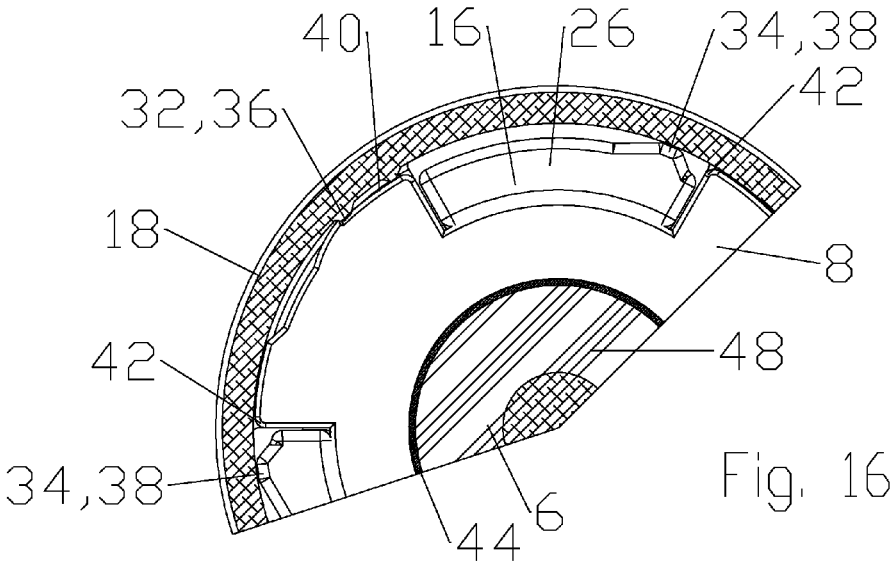
FIG. 16 is a close-up view of FIG. 15, cut along line B-B with the releasable retainer rotated sixty degrees to the initial insertion position.
Figure 17:
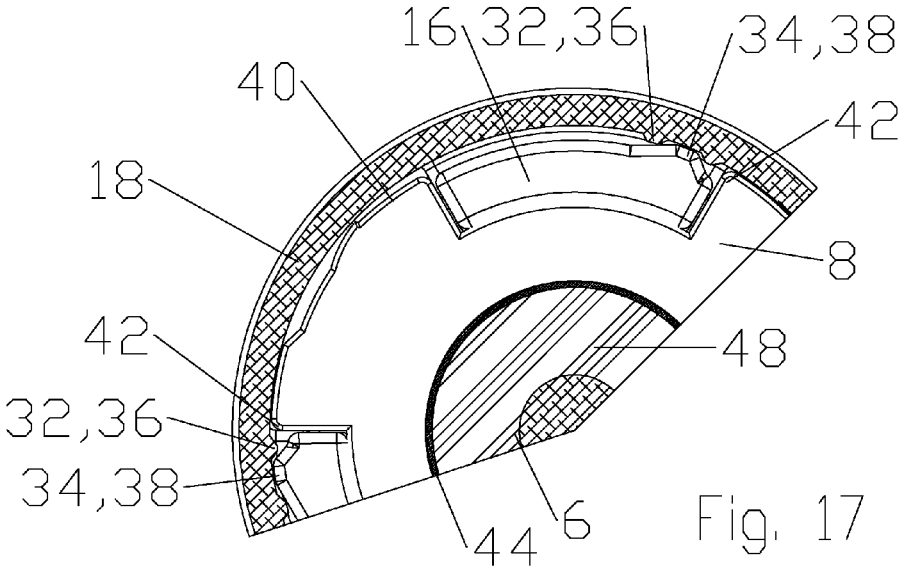
FIG. 17 is a view of FIG. 16, with the releasable retainer in the locked position.

The initial alignment of the releasable retainer 18 upon the male portion 8, for ease of male portion 8 insertion into and seating with the female portion 16, and/or rotatability characteristics of the releasable retainer 18 upon interconnection, may be controlled by interlock features of the releasable retainer 18 and the outer diameter surfaces of the base and/or connector tabs 26, 10, for example as shown in FIGS. 15-17.

A rotation lock of the releasable retainer 18, retaining the releasable retainer 18 in the engaged position, may be created by providing a tab seat lock 32 (see FIG. 5) on a sidewall of the tab seat 24 that meshes with a base tab lock 34 (see FIG. 10) provided on an outer diameter of the base tab 26, when the releasable retainer 18 is rotated into the engaged position. The tab seat lock 32 may be formed, for example, as a pair of radially inward protrusions 36 which the base tab lock 34, formed as a radial outward protrusion 38, seats between.

As best shown in FIG. 16, circumferential alignment of the releasable retainer 18 on the male portion 8 during initial insertion may be assisted by an outer diameter insertion surface 40 dimensioned to engage the tab seat lock 32 in an interference fit, retaining the releasable retainer 18 aligned in an in-line insertion position with respect to the connector tabs 10 so that the base tabs 26 can mesh with the connector tabs 10 as the outer sidewall 30 of the annular groove 28 is mated with the conical outer sidewall 30, without interference from the coupling tabs 22 retained in the shadow of the connector tabs 10. The interference fit between the tab seat lock 32 and the insertion surface 40 may be provided at a level of interference which retains the releasable retainer 18 in place as the male portion 8 is inserted through adjacent connectors and/or cables towards the female portion 16, but which allows rotation of the releasable retainer 18 to slide the tab seat lock 32 away from the insertion surface 40 upon application of torque to begin the rotation of the releasable retainer 18 with respect to the male and female portions 8, 16 as the releasable retainer 18 is rotated to the engaged position during final interconnection.

As the male and female portions 8, 16 may be visually obscured by the adjacent apparatus and/or cables during interconnection, a tactile feedback that the engagement position has been reached may be provided by a click action as the base tab lock 34 drops into engagement with the tab seat lock 32. Further feedback that the engagement position has been reached may be provided by dimensioning the connector tab 10 with an outer diameter stop surface 42 dimensioned to provide a positive stop with respect to rotation of the tab seat lock 32 past the base tab lock 34 (see FIG. 17). Thereby, the installer is unable to over-rotate the releasable retainer 18 past the engagement position.

The cable end 15 of the base tabs 26 and/or coupling tabs 22 may be provided with an angled engagement surface 52 (see FIG. 11) for ease of initial engagement therebetween. Thereby, as the releasable retainer 18 is rotated, the coupling tab 22 is driven against the angled engagement surface 52 and the coupling tab 22 is progressively drawn toward the cable end 15 as the coupling tab 22 advances along the engagement surface 52, driving the male portion 8 into engagement with the female portion 16.

One skilled in the art will appreciate that the connector tabs 10 mesh with the base tabs 26 as the outer diameter seat surface 12 is seated against the outer sidewall 30 (see FIG. 15), inhibiting rotation of the male portion 8 with respect to the female portion 16, allowing the releasable retainer 18 to be rotated without requiring an additional tool to inhibit rotation of the male portion 8, for example where the female portion 16 is configured for panel surface mounting via a mounting flange 53.

The stop shoulder 20 of the releasable retainer 18 may be formed with a retention lip 54 that projects radially inward (see FIG. 5). Thereby, the retention lip 54 may engage a corresponding radially outward protruding retention spur 56 of the male portion 8 (see FIG. 7), retaining the releasable retainer 18 upon the male portion 8 at the cable end 15. The retention spur 56 may be formed directly in the outer diameter of the male portion 8 or alternatively on an overbody 58 covering an outer diameter of the male portion 8 between the cable end 15 and the connector tabs 10. The overbody 58 may be sealed against a jacket of the cable 6 to provide both an environmental seal for the cable end of the interconnection and a structural reinforcement of the cable 6 to male portion 8 interconnection.

Returning to FIG. 14, a further environmental seal may be formed by applying an annular seal groove 60 in the outer diameter seat surface 12, in which a seal 62 such as an elastometric o-ring or the like may be seated. Because of the conical mating between the outer diameter seat surface 12 and the outer side wall 30, the seal 62 may experience reduced insertion friction compared to that encountered when seals are applied between telescoping cylindrical surfaces, enabling the seal 62 to be slightly over-sized, which may result in an improved environmental seal between the outer diameter seat surface 12 and the outer side wall 30.

The present embodiment demonstrates a coaxial cable outer conductor 44 to connector 4 interconnection in the male portion 8 which passes the outer conductor 44 through the male portion 8 into direct contact with the female portion 16, circumferentially clamped at the interconnection therebetween. Thereby, the several additional connector elements and/or internal connections common in conventional coaxial connectors with a cable to connector retention based upon interconnection with the outer conductor 44 may be eliminated. As best shown in FIG. 14, an inner sidewall 46 of the annular groove 28 is dimensioned to seat against a flared end of the outer conductor 44 of the coaxial cable 6 inserted through a bore 48 of the male portion 8, clamping the outer conductor 44 between the male and female portions 8, 16 when the outer diameter seat surface 12 is seated against the outer sidewall 30. One skilled in the art will appreciate that a direct pass through of the outer conductor 44 eliminates potential PIM sources present between each additional surface/contact point present in a conventional coaxial cable connector termination.

Alternatively, the seat surface 12 may be applied dimensioned to seat at the annular groove 28 as the primary contact of the interconnection, and the flared end of the outer conductor 44 coupled to the inner sidewall 46 as further described herebelow. Although an intimate contact may occur between the flared end of the outer conductor 44 and the outer sidewall 30, because the outer conductor 44 is already coupled (preferably molecular bond coupled) to the male portion 8, in this embodiment a high level "clamping force" is not required to secure the interconnection. Thereby, the strength requirements of the releasable retainer 18 and the interconnecting portions of the male and female portions 8, 16 it engages may be reduced.

Prior to interconnection, the leading end of the cable 6 may be prepared by cutting the cable 6 so that inner conductor(s) 63 extend from the outer conductor 44. Also, a dielectric material that may be present between the inner conductor(s) 63 and outer conductor 44 may be stripped back and a length of the outer jacket removed to expose desired lengths of each. The inner conductor 63 may be dimensioned to extend through the attached coaxial connector for direct interconnection with the female portion 16 as a part of the connection interface. Alternatively, for example where the connection interface selected requires an inner conductor profile that is not compatible with the inner conductor 63 of the selected cable 6 and/or where the material of the inner conductor 63 is an undesired inner conductor connector interface material, such as aluminum, the inner conductor 63 may be terminated by applying an inner conductor cap 64 (See FIG. 14).

To further eliminate PIM generation also with respect to the connection interface between the coaxial connectors, the outer conductor 44 may be coupled to the male portion 8 (preferably by molecular bond interconnection) and the connection interface modified to apply capacitive coupling, instead of conventional "physical contact" galvanic electromechanical coupling.

Capacitive coupling may be obtained by applying a dielectric spacer between the inner and/or outer conductor contacting surfaces of the connector interface. Capacitive coupling between spaced apart conductor surfaces eliminates the direct electrical current interconnection between these surfaces that is otherwise subject to PIM generation/degradation as described herein above with respect to cable conductor to connector interconnections. The dielectric spacer(s) may be applied, for example, as separate elements positioned between interconnection surfaces and/or alternatively as dielectric coatings, such as ceramic coatings, applied directly upon an interconnection surface.

The exemplary embodiments are demonstrated with respect to a cable 6 that is an RF-type coaxial cable. One skilled in the art will appreciate that the connection interface may be similarly applied to any desired cable 6, for example multiple conductor cables, power cables and/or optical cables, by applying suitable conductor mating surfaces/individual conductor interconnections aligned within the bore 48 of the male and female portions 8, 16.

Contrary to conventional connection interfaces featuring threads requiring precision seating orientation to initiate threading and then repeated rotation of a threaded coupling nut or the like, until a high torque level is applied, to create a secure interconnection, an exemplary embodiment of the connector interface requires only the rough alignment for seating of the tabs with respect to each other and then insertion there along until the seat surface 12 bottoms in the annular groove 28. A three tab configuration provides a sixty degree rotation engagement characteristic. That is, the interconnection may be fully engaged by rotating the releasable retainer 18 only sixty degrees with respect to the female portion 16. Further, a generally symmetrical distribution of the tabs provides symmetrical support to the interconnection along the longitudinal axis.

One skilled in the art will appreciate that the number of tabs may be increased, the angular rotation engagement characteristic decreases proportionally. For example, where four sets of tabs are applied, the angular rotation requirement between initial insertion and fully engaged positions is further reduced to forty-five degrees. As the number of tabs is increased a tradeoff may apply in that the area available on the base tabs 26 for an engagement surface 52 decreases, which may require a steeper angle on the engagement surface 52 and/or otherwise complicate initial engagement characteristics. As the dimensions of the individual tabs decrease, materials with increased strength characteristics may be required.

Because the interconnection does not rely only upon thread friction to retain the interconnection, torque requirements may be significantly reduced and/or the total throw required to engage/disengage the interconnection via rotation of the releasable retainer 18 is a fraction of a single rotation, depending upon the number of base tabs 26 applied, the interconnection may be configured for tool-less operation by providing a handle projection 65 extending from the releasable retainer 18.

Figure 22:
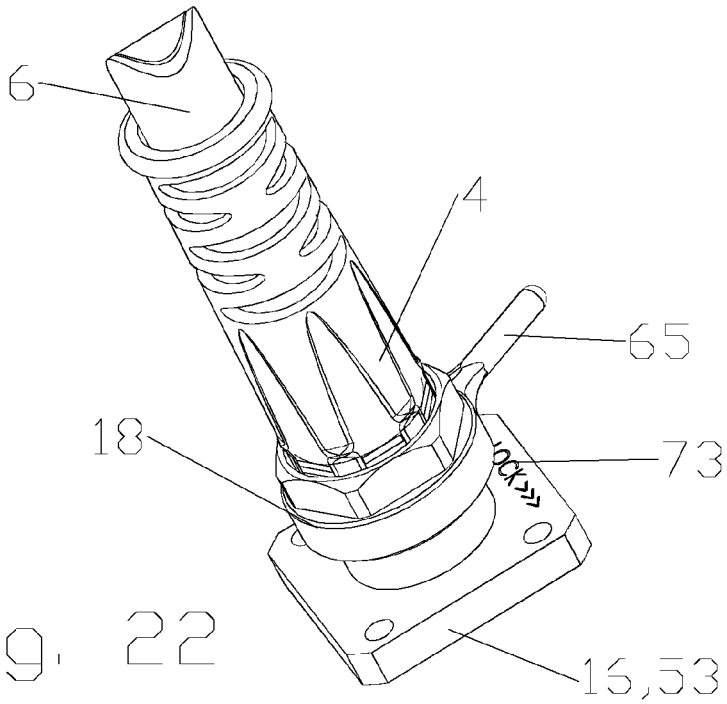
FIG. 22 is a schematic isometric view of an alternative tool-less embodiment of the interconnection, in the engaged position.
Figure 23:
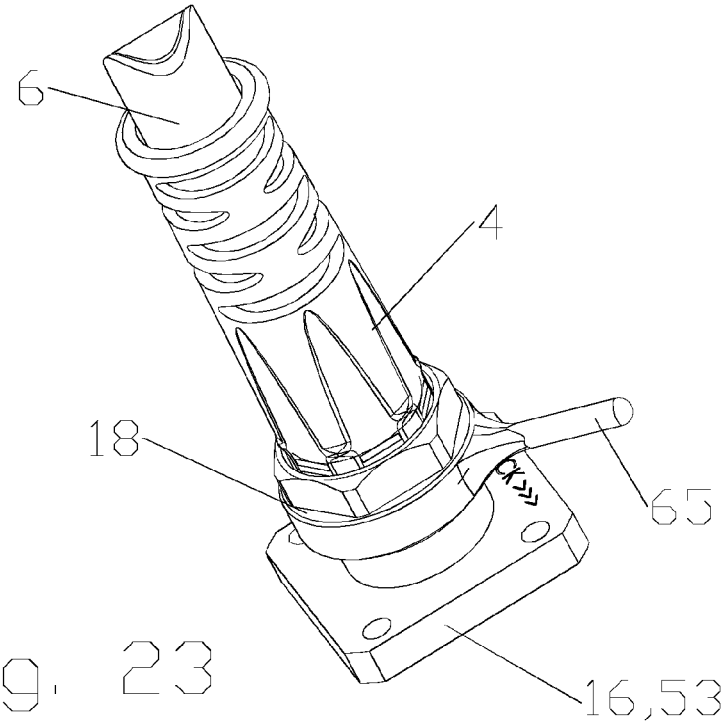
FIG. 23 is a schematic isometric view of the interconnection of FIG. 22, in the dis-engaged position.
Figure 24:
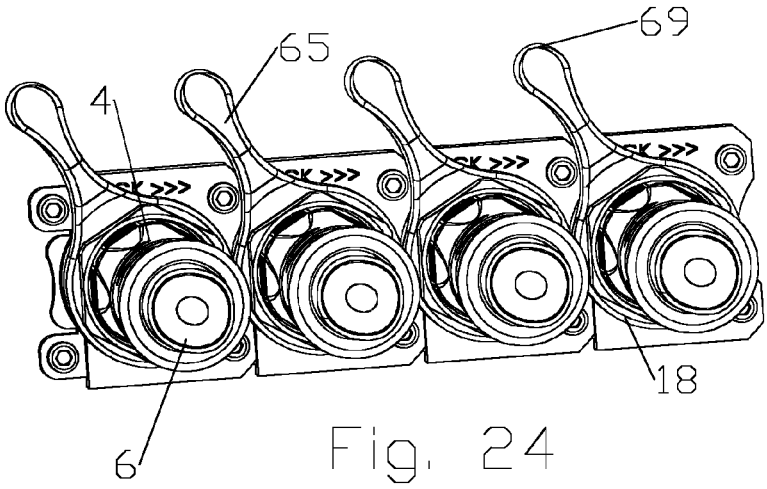
FIG. 24 is a schematic isometric view of an extreme close-quarters embodiment of the interconnection with all connectors in the engaged position.
Figure 25:
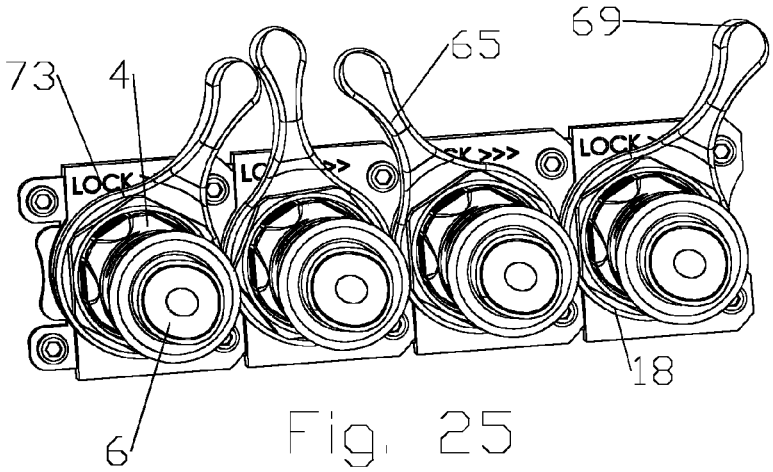
FIG. 25 is a schematic isometric view of the interconnection of FIG. 24, demonstrating potential interference between the handle projections.
Figure 26:
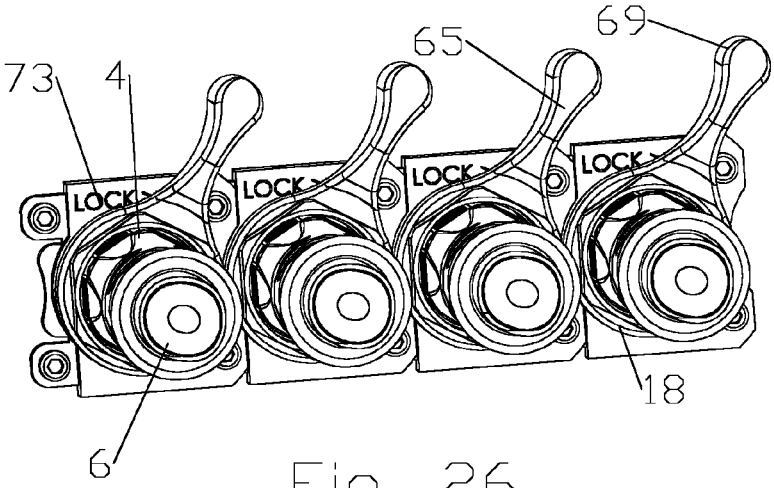
FIG. 26 is a schematic isometric view of the interconnection of FIG. 24, with all connectors in the dis-engaged position.
Figure 27:
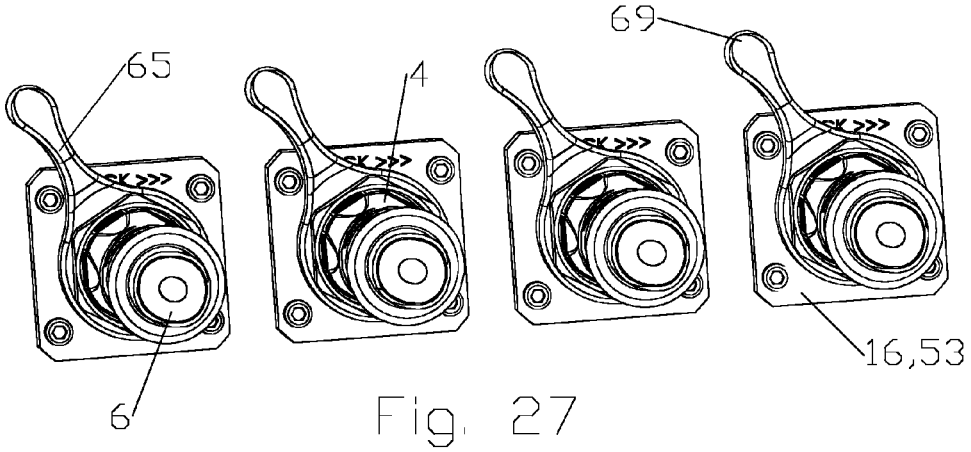
FIG. 27 is a schematic isometric view of a close-quarters embodiment of the interconnection with minimum spacing to avoid interference between the handle projections, with all connectors in the engaged position.
Figure 28:
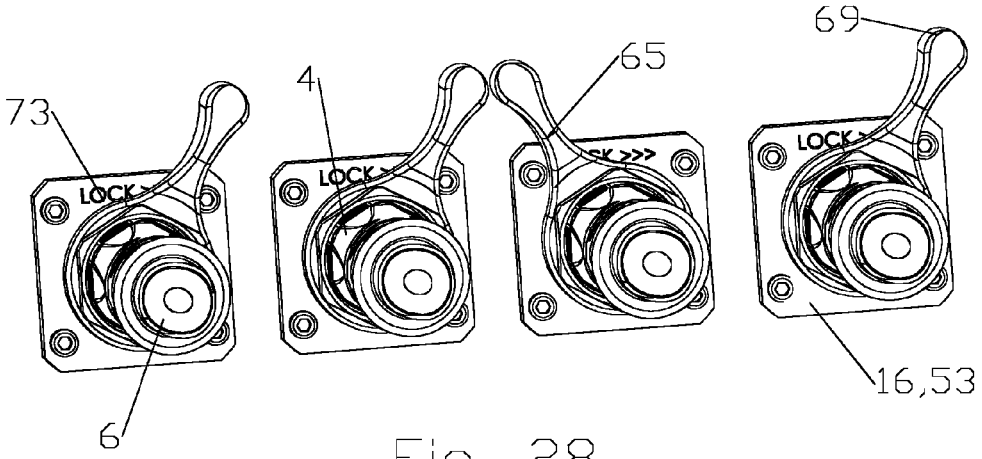
FIG. 28 is a schematic isometric view of the interconnection of FIG. 27, with three connectors in the dis-engaged position and one connector in the engaged position to demonstrate the absence of interference between the handle projections.
Figure 29:
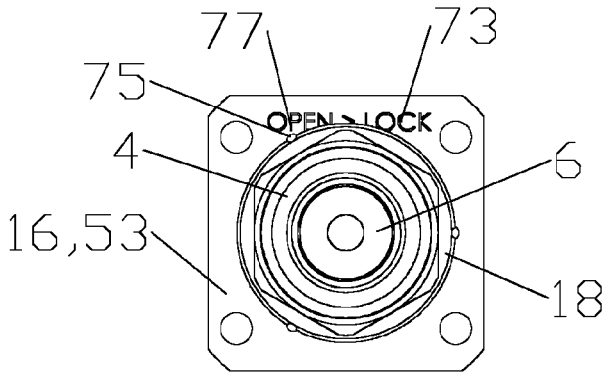
FIG. 29 is a schematic end view of a visual indicia embodiment of the interconnection, in the disengaged position.
Figure 30:
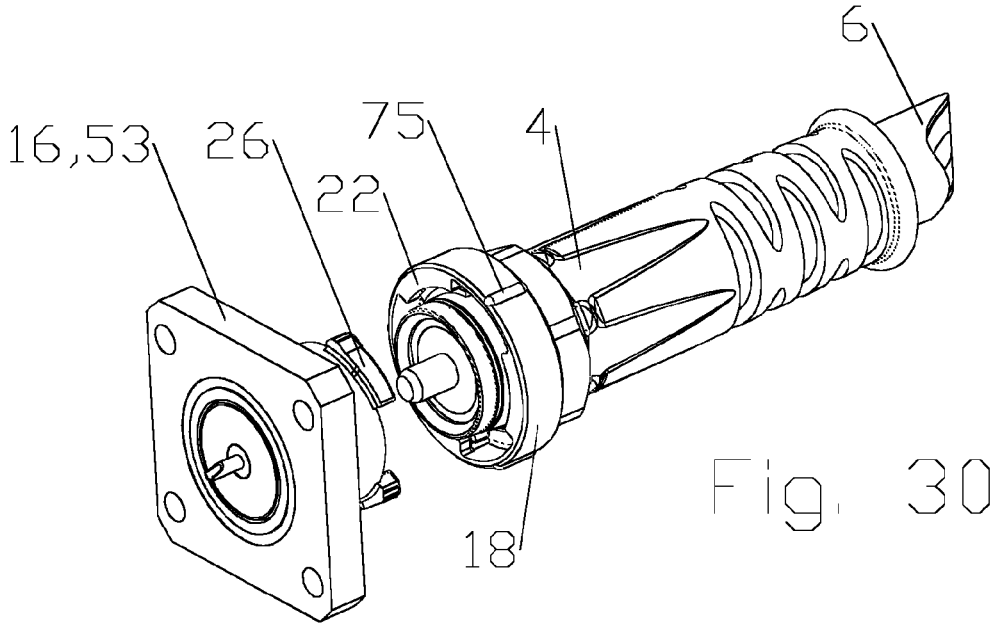
FIG. 30 is a schematic isometric view of the interconnection of FIG. 29, with the male and female portions separated prior to seating against one another.
Figure 31:
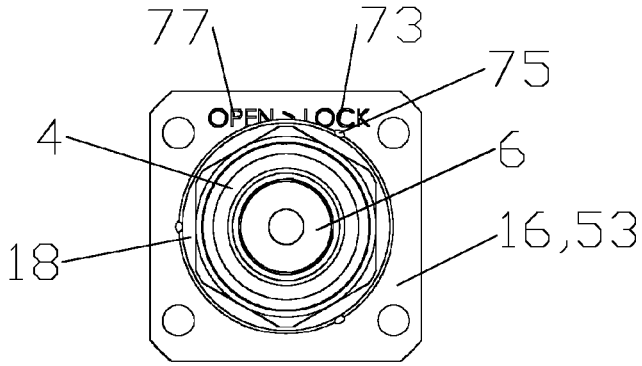
FIG. 31 is a schematic end view of the interconnection of FIG. 29, in the engaged position.
Figure 32:
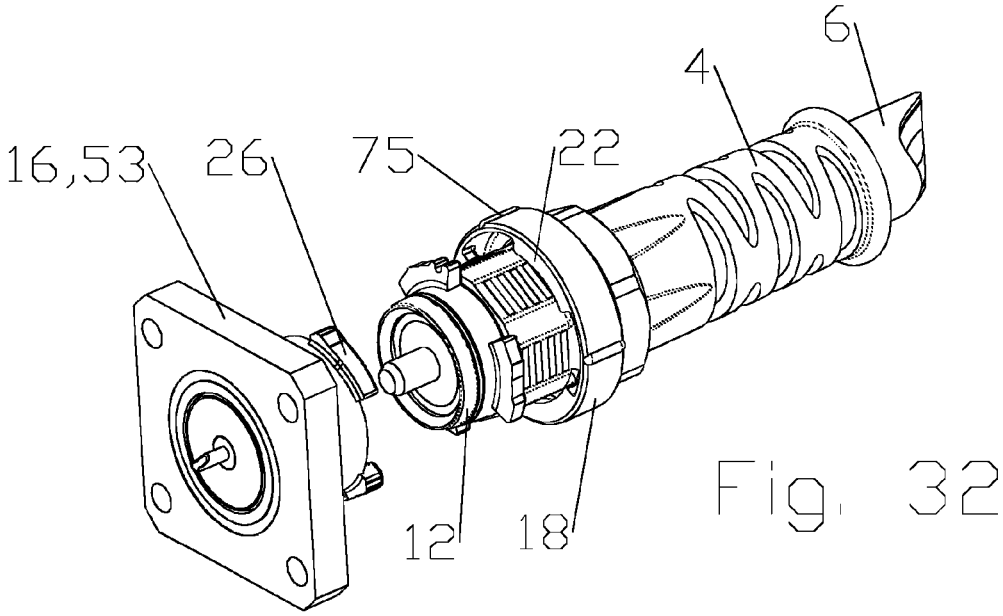
FIG. 32 is a schematic isometric view of the interconnection of FIG. 31, separated and the releasable retainer moved back from the interface end.

The handle projection 65 may be provided, for example as shown in FIGS. 18-21, extending from an outer diameter of the releasable retainer 18, ergonomically streamlined for ease of finger grip/engagement with an enlarged distal end 69. Alternatively, the handle projection 65 may be provided as any grippable protrusion, such as cylindrical arm, as demonstrated in FIGS. 22 and 23, to conserve materials and/or weight.

Where only a single handle projection 65 is applied, a close quarters/high density mounting characteristic is enabled, for example as shown in FIGS. 24-26, while retaining the tool-less interconnection functionality. In extreme close quarters, to avoid interference with respect to the handle projection 65, adjacent connectors may be required to be engaged/disengaged together, as demonstrated in FIGS. 24-26. Alternatively, as demonstrated in FIGS. 27 and 28 a significant close quarters spacing may be obtained, while still enabling independent tool-less operation of each connector 4, separate from the others, without interference.

Additionally and/or alternatively the interconnection may be provided with visual feedback indicia for ready indication of the open or locked state of the interconnection.

Figure 18:
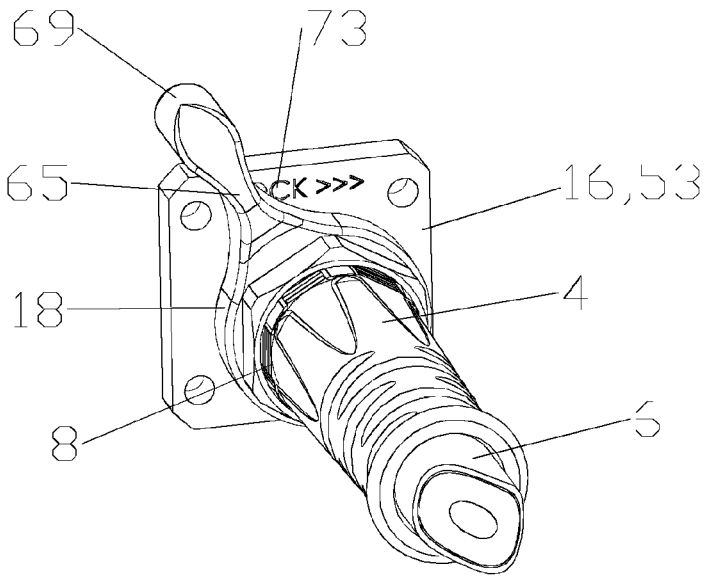
FIG. 18 is a schematic isometric view of a tool-less embodiment of the interconnection, in the dis-engaged position.
Figure 19:
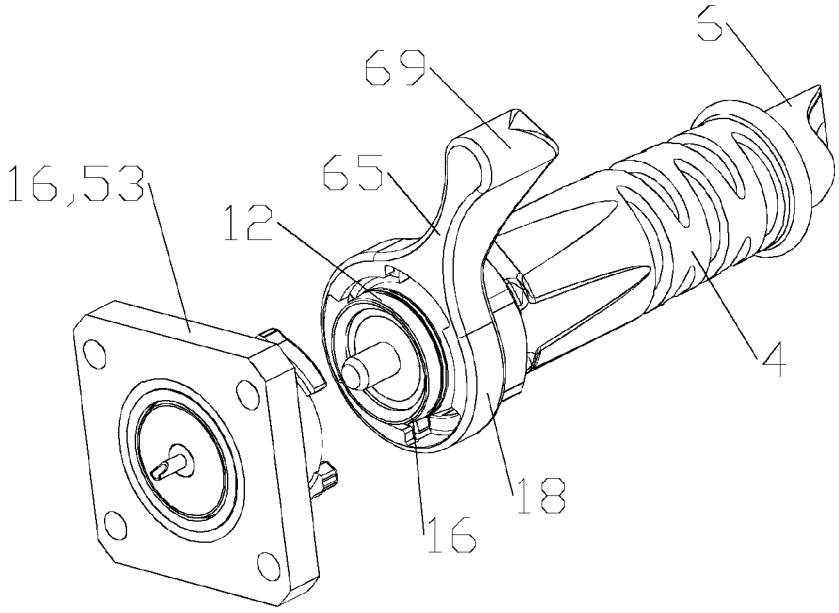
FIG. 19 is a schematic isometric view of the interconnection of FIG. 18, with the male and female portions separated prior to seating against one another.
Figure 20:
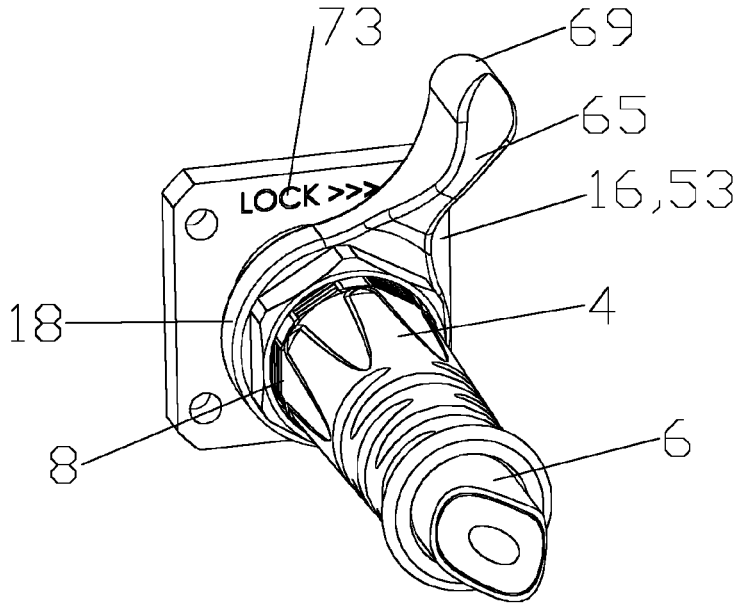
FIG. 20 is a schematic isometric view of the interconnection of FIG. 18, in the engaged position.
Figure 21:
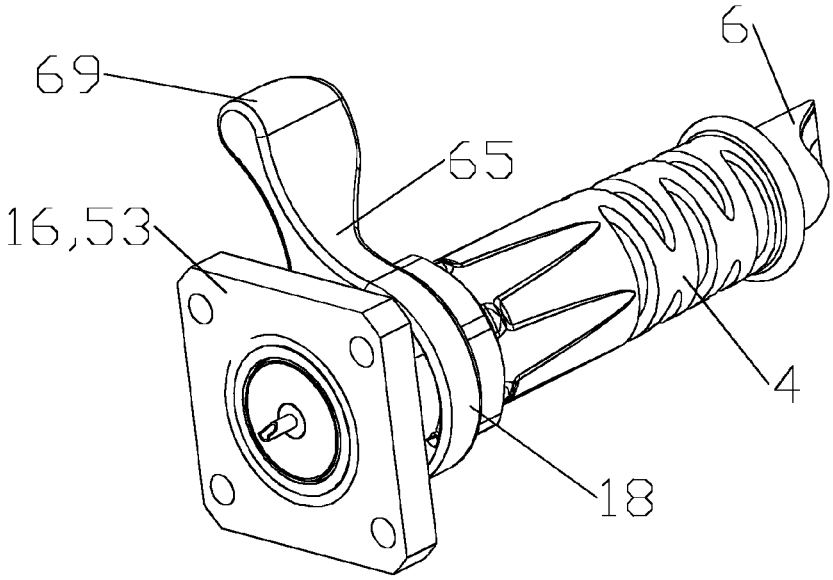
FIG. 21 is a schematic isometric view of the interconnection of FIG. 20.

The visual feedback indicia may be provided on the female portion 16, for example on the mounting flange 53, positioned such that the handle projection 65 will cover and/or obscure indicia identifying the alternative position. That is, when the interconnection is in the engaged position, an engagement verification indicia 73, such as "locked" may be visible, and when the interconnection is in the disengaged position, the engagement verification indicia 73 may be covered and/or obscured by the handle projection 65, for example as shown in FIGS. 18 and 20.

Where only visual feedback is desired, an indicator 75 of a size sufficient to be discerned by the user, such as a protrusion or indentation, may be provided on the releasable retainer 18, for example as shown in FIGS. 29-32. The indicator 75 may be configured to alternate between proximity with engagement verification indicia 73 and disengagement verification indicia 77 provided on the female portion 16, depending upon the engagement state of the interconnection, according to the position of the releasable retainer 18.

One skilled in the art will further appreciate that the tabbed connector interface may provide a quick connect rigid interconnection with improved electrical characteristics and a reduced number of discrete elements, which may simplify manufacturing and/or assembly requirements. The interconnection may be configured for ease of application/removal by hand, without additional tool requirements. Visual indicia may be applied to provide instant feedback that proper engagement has been obtained; further simplifying installation and/or maintenance of the interconnection.

Table of Parts

| | |
|---|---|
| 2 | wrench |
| 4 | connector |
| 6 | cable |
| 8 | male portion |
| 10 | connector tab |
| 12 | seat surface |
| 14 | interface end |
| 15 | cable end |
| 16 | female portion |
| 18 | releasable retainer |
| 20 | stop shoulder |
| 22 | coupling tab |
| 24 | tab seat |
| 26 | base tab |
| 28 | annular groove |
| 30 | outer sidewall |
| 32 | tab seat lock |
| 34 | base tab lock |
| 36 | inward protrusion |
| 38 | outward protrusion |
| 40 | insertion surface |
| 42 | stop surface |
| 44 | outer conductor |

-continued

| Table of Parts | |
|---|---|
| 46 | inner sidewall |
| 48 | bore |
| 50 | flare surface |
| 52 | engagement surface |
| 53 | mounting flange |
| 54 | retention lip |
| 56 | retention spur |
| 58 | overbody |
| 60 | seal groove |
| 62 | seal |
| 63 | inner conductor |
| 64 | inner conductor cap |
| 65 | handle projection |
| 69 | distal end |
| 73 | engagement verification indicia |
| 75 | indicator |
| 77 | disengagement verification indicia |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A cable connector interface, comprising:

a male portion with at least three outer diameter radially projecting connector tabs; the male portion provided with a conical outer diameter seat surface at an interface end;

a releasable retainer dimensioned to seat around the male portion, a female portion with at least three outer diameter radial projecting base tabs and an annular groove open to the interface end with an outer sidewall dimensioned to mate with the conical outer diameter seat surface;

the connector tabs mesh with the base tabs as the conical outer diameter seat surface is seated against the outer sidewall, inhibiting rotation of the male portion with respect to the female portion;

the releasable retainer dimensioned to engage the base tabs, upon rotation of the releasable retainer, retaining the conical outer diameter seat surface against the outer sidewall.

2. The connector interface of claim 1, further including a handle projection extending radially from an outer diameter of the releasable retainer.

3. The connector interface of claim 2, wherein the handle projection has an enlarged distal end.

4. The connector interface of claim 2, further including visual feedback indicia on the female portion.

5. The connector interface of claim 4, wherein the visual feedback indicia is an engagement verification indicia, which is uncovered by the handle projection when the releasable retainer is in an engaged position and covered when the handle projection is in a dis-engaged position.

6. The connector interface of claim 1, further including an indicator on the releasable retainer, the indicator proximate an engagement verification indicia on the female portion when the releasable retainer is in an engaged position and proximate a disengagement verification indicia when the releasable retainer is in a dis-engaged position.

7. The connector interface of claim 6, wherein the indicator is a protrusion provided on an outer diameter of the releasable retainer.

8. The connector interface of claim 6, wherein the indicator is an indentation provided on an outer diameter of the releasable retainer.

9. The connector interface of claim 1, wherein a cable end of the base tab is provided with an angled engagement surface; the engagement surface progressively drawing the coupling tab and thereby the male portion towards the female portion as the releasable retainer is rotated.

10. The connector interface of claim 1, wherein the releasable retainer is provided with a stop shoulder with a radially inward projecting retention lip; the retention lip engaging a radial outward protruding retention spur of the male portion, retaining the releasable retainer upon the male portion.

11. The connector interface of claim 10, wherein the retention spur is provided on an overbody covering an outer diameter of the male portion between a cable end and the connector tabs.

12. The connector interface of claim 1, further including an annular groove provided in the outer diameter seat surface, in which a seal is seated.

13. A method for interconnecting an electrical connector, comprising:

providing a male portion with at least three outer diameter radially projecting connector tabs; the male portion provided with a conical outer diameter seat surface at an interface end;

seating a releasable retainer around the male portion;

inserting the interface end of the male portion into an interface end of a female portion with at least three outer diameter radially projecting base tabs, and an annular groove open to the interface end with an outer sidewall dimensioned to mate with the conical outer diameter seat surface; and the connector tabs mesh with the base tabs as the conical outer diameter seat surface is seated against the outer sidewall, inhibiting rotation of the male portion with respect to the female portion; and rotating the releasable retainer to engage the base tabs, thereby retaining the conical outer diameter seat surface against the outer sidewall.

14. The method of claim 13, wherein the rotation of the releaseable retainer is sixty degrees or less.

15. The method of claim 13, wherein the releasable retainer is rotated via grasping a handle projection extending from an outer diameter of the releaseable retainer.

16. The method of claim 13, wherein the connector tab is provided with an outer diameter stop surface dimensioned to provide a positive stop with respect to rotation of the tab seat lock past the base tab lock.

17. The method of claim 13, wherein a cable end of the base tab is provided with an angled engagement surface; the engagement surface progressively drawing a coupling tab of the releasable retainer and thereby the male portion towards the female portion as the releasable retainer is rotated.

18. The method of claim 13, further including rotating the releasable retainer until an engagement verification indicia of the female portion is exposed by the releasable retainer.

* * * * *